US009133658B2

(12) United States Patent
Kuperus et al.

(10) Patent No.: US 9,133,658 B2
(45) Date of Patent: Sep. 15, 2015

(54) SOUND ATTENUATING COVERING FOR AN ARCHITECTURAL OPENING

(71) Applicant: Hunter Douglas Inc., Pearl River, NY (US)

(72) Inventors: Ko Kuperus, Superior, CO (US); Fabian Ruffo, Las Vegas, NV (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 14/195,906

(22) Filed: Mar. 4, 2014

(65) Prior Publication Data

US 2014/0250804 A1 Sep. 11, 2014

Related U.S. Application Data

(60) Provisional application No. 61/772,944, filed on Mar. 5, 2013.

(51) Int. Cl.

| | |
|---|---|
| ***E04D 13/18*** | (2014.01) |
| ***E06B 7/00*** | (2006.01) |
| ***E06B 9/40*** | (2006.01) |
| ***E06B 9/262*** | (2006.01) |
| ***E06B 9/58*** | (2006.01) |
| *E06B 9/24* | (2006.01) |

(52) U.S. Cl.

CPC . *E06B 7/00* (2013.01); *E06B 9/262* (2013.01); *E06B 9/40* (2013.01); *E06B 9/582* (2013.01); *E06B 2009/2458* (2013.01); *E06B 2009/2622* (2013.01); *E06B 2009/588* (2013.01)

(58) Field of Classification Search

CPC ..... E06B 2009/2458; E06B 2009/2622; E06B 7/00

USPC ..... 52/173.1, 202, 204.5; 160/120, 239

See application file for complete search history.

(56) References Cited

U.S. PATENT DOCUMENTS

| | | | |
|---|---|---|---|
| 1,937,342 | A | 11/1933 | Higbie |
| 2,267,869 | A | 12/1941 | Loehr |
| 2,770,298 | A | 11/1956 | Hiatt |
| 2,914,122 | A | 11/1959 | Pinto |
| 2,994,370 | A | 8/1961 | Pinto |
| 3,092,870 | A | 6/1963 | Baer |
| 3,302,690 | A | 2/1967 | Hurd |
| 3,411,561 | A | 11/1968 | Mock |
| 3,422,878 | A | 1/1969 | Galietti |

(Continued)

FOREIGN PATENT DOCUMENTS

| | | |
|---|---|---|
| CA | 2777454 A1 | 11/2012 |
| CA | 142500 | 2/2013 |

(Continued)

*Primary Examiner* — Basil Katcheves

(74) *Attorney, Agent, or Firm* — Dorsey & Whitney LLP

(57) ABSTRACT

A sound attenuating covering for an architectural opening is provided. The covering may include a frame, a first shade, and a second shade. The frame may include opposing side members, each defining an opposing channel extending along at least a portion of the side member. The first shade may be positioned forward of the frame and may define a plurality of horizontally-extending, transversely-collapsible cells. The second shade may be positioned rearward of the first shade and may be slidably received within the channels of the side members. The first and second shades may be operably coupled to a roller and may move in conjunction with one another across the architectural opening.

17 Claims, 10 Drawing Sheets

(56) References Cited

U.S. PATENT DOCUMENTS

| | | | |
|---|---|---|---|
| 3,844,330 | A | 10/1974 | Hyman |
| 3,851,699 | A | 12/1974 | Shapiro |
| 3,946,789 | A | 3/1976 | Ronkholz-Tolle |
| 4,114,233 | A | 9/1978 | Hamilton |
| 4,342,354 | A | 8/1982 | Leivenzon et al. |
| 4,438,605 | A | 3/1984 | DeLucia |
| 4,741,375 | A | 5/1988 | Milford et al. |
| 4,846,243 | A | 7/1989 | Schneider |
| 4,934,435 | A | 6/1990 | Regev |
| 5,012,552 | A | 5/1991 | Wulf |
| 5,090,098 | A | 2/1992 | Seveik et al. |
| 5,097,884 | A | 3/1992 | Sevcik et al. |
| 5,099,904 | A | 3/1992 | Susnar |
| 5,102,598 | A | 4/1992 | Chen |
| 5,105,870 | A | 4/1992 | Merjane |
| 5,129,440 | A | 7/1992 | Colson |
| 5,143,136 | A | 9/1992 | John |
| 5,158,632 | A | 10/1992 | Colson et al. |
| 5,205,334 | A | 4/1993 | Judkins |
| 5,273,096 | A | 12/1993 | Thomsen et al. |
| 5,287,908 | A | 2/1994 | Hoffmann et al. |
| 5,313,998 | A | 5/1994 | Colson et al. |
| 5,313,999 | A | 5/1994 | Colson et al. |
| D348,371 | S | 7/1994 | Judkins |
| 5,339,883 | A | 8/1994 | Colson et al. |
| 5,392,833 | A | 2/1995 | Ohanesian |
| 5,419,385 | A | 5/1995 | Vogel et al. |
| 5,425,408 | A | 6/1995 | Colson |
| 5,490,553 | A | 2/1996 | Colson et al. |
| 5,566,735 | A | 10/1996 | Jelic |
| 5,690,156 | A | 11/1997 | Ruggles |
| 5,718,799 | A | 2/1998 | Colson et al. |
| 6,001,199 | A | 12/1999 | Colson et al. |
| D445,621 | S | 7/2001 | Judkins |
| D446,070 | S | 8/2001 | Judkins |
| D468,950 | S | 1/2003 | Judkins |
| D473,743 | S | 4/2003 | Judkins |
| 6,712,115 | B2 | 3/2004 | Judkins |
| 6,964,291 | B2 | 11/2005 | Judkins |
| D659,455 | S | 5/2012 | Marocco |
| D659,456 | S | 5/2012 | Marocco |
| 8,807,192 | B2 | 8/2014 | Marocco |
| 8,857,495 | B2 | 10/2014 | Marocco |
| 2005/0087309 | A1 | 4/2005 | Nien et al. |
| 2009/0277593 | A1 | 11/2009 | Stewart |
| 2009/0277594 | A1 | 11/2009 | Stewart et al. |
| 2011/0265963 | A1 | 11/2011 | Drew et al. |
| 2012/0107037 | A1 | 5/2012 | Huang |
| 2012/0222824 | A1 | 9/2012 | Lin |
| 2012/0291964 | A1 | 11/2012 | Marocco |
| 2012/0291965 | A1 | 11/2012 | Marocco |

FOREIGN PATENT DOCUMENTS

| | | | |
|---|---|---|---|
| CA | 142501 | | 2/2013 |
| CA | 145759 | | 2/2013 |
| EP | 0653539 | A1 | 5/1995 |
| EP | 0654577 | A1 | 5/1995 |
| WO | 9425719 | A1 | 11/1994 |
| WO | 2011090975 | A1 | 7/2011 |
| WO | 2013/033014 | A1 | 3/2013 |

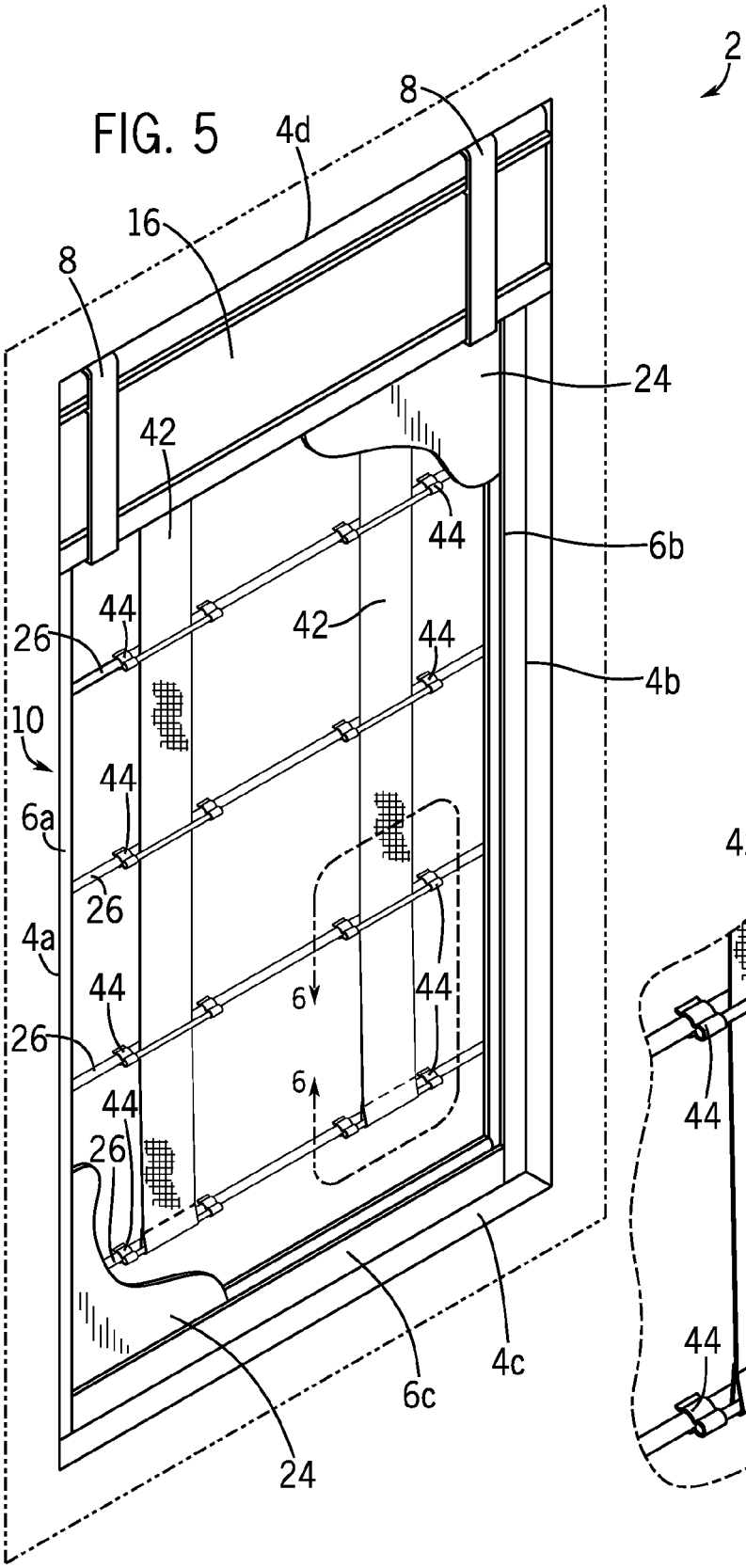
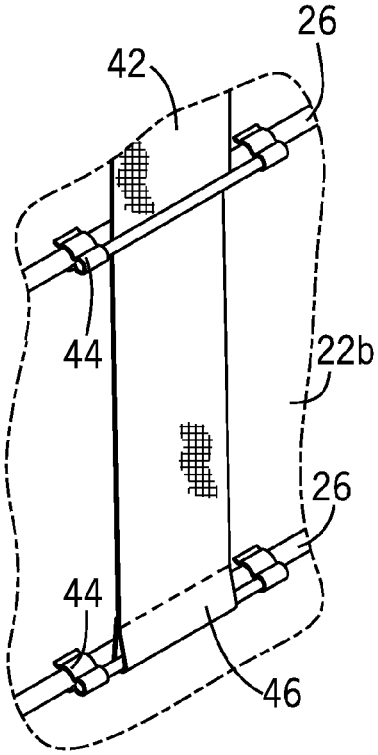
FIG. 6

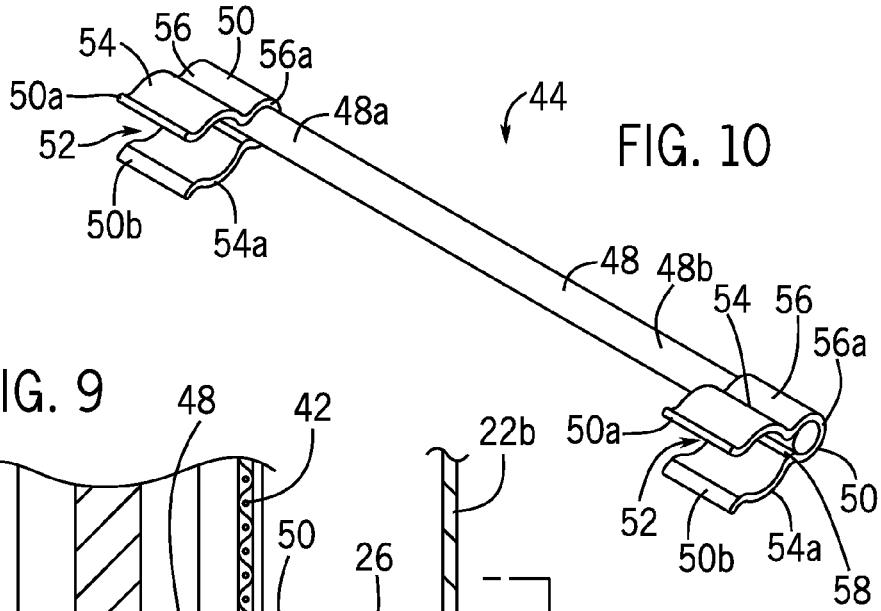
FIG. 10
FIG. 9
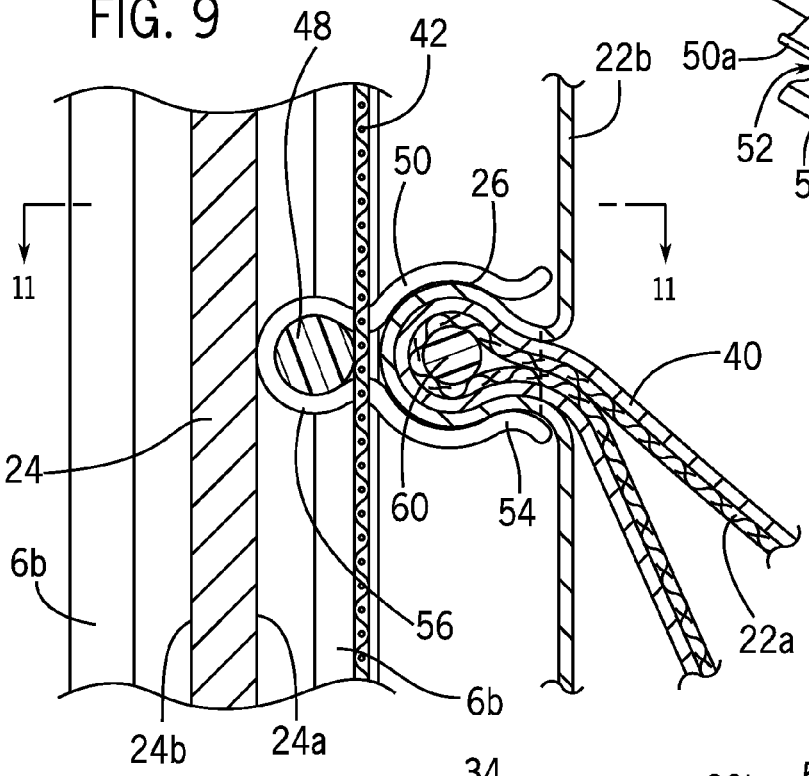
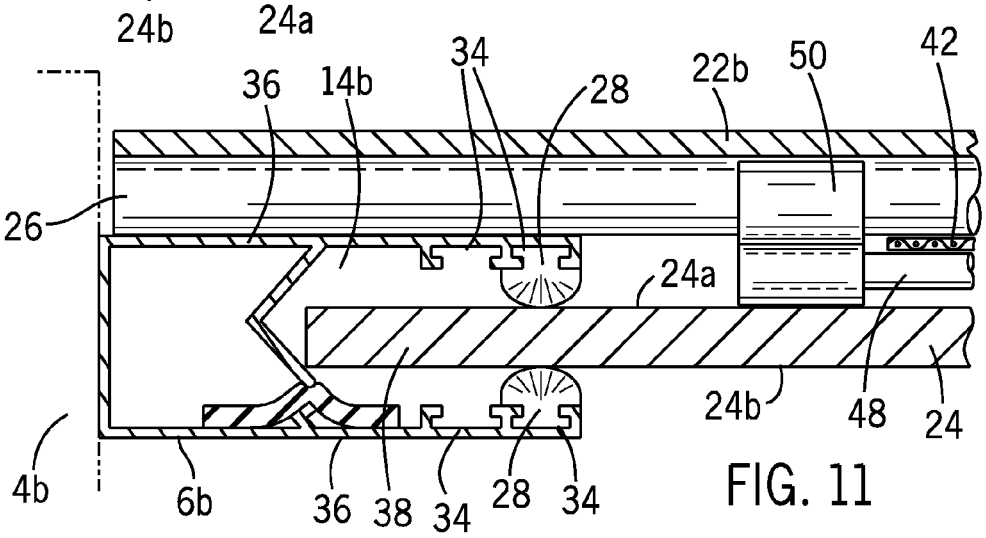
FIG. 11

SOUND ATTENUATING COVERING FOR AN ARCHITECTURAL OPENING

CROSS-REFERENCE TO RELATED APPLICATION

This application claims the benefit under 35 U.S.C. 119(e) of U.S. Provisional Application No. 61/772,944, filed Mar. 5, 2013, which is hereby incorporated by reference herein in its entirety.

FIELD

The present disclosure relates generally to coverings for architectural openings and, more particularly, to a sound attenuating covering for an architectural opening.

BACKGROUND

Coverings for architectural openings, such as windows, doors, archways, and the like, have taken numerous forms for many years. Some coverings include a retractable shade that is movable between an extended position and a retracted position. In the extended position, the shade of the covering may be positioned across the opening. In the retracted position, the shade of the covering may be positioned adjacent one or more sides of the opening.

Conventional coverings provide numerous functions, including light control, energy efficiency, and privacy. One area of need is in the area of sound attenuation. For example, in commercial applications, such as hotel buildings, high levels of exterior sound often results in guest complaints, which may ultimately result in bad publicity and decreased occupancy for the hotel. In residential applications, high levels of exterior sound (such as dogs barking and other sound nuisances) often results in neighborly disputes, among other things. Conventional coverings may provide some level of sound attenuation. However, in some applications additional sound attenuation is desired.

SUMMARY

Examples of the disclosure may include a sound attenuating covering for an architectural opening. The covering may include a frame, a first shade, and a second shade. The frame may include opposing side members, each defining an opposing channel extending along at least a portion of the side member. The frame also may include a bottom member extending transversely between the opposing side members and defining a channel configured to receive a bottom portion of the second shade. The first shade may be positioned forward of the side members. The first shade also may be positioned forward of the bottom member. The first shade may define a plurality of horizontally-extending, transversely-collapsible cells. The second shade may be positioned rearward of the first shade. The second shade may be slidably received within the channels of the side members. The second shade also may be slidably received within the channel of the bottom member.

In another example, the covering may include a head rail, a rotatable roller housed within the head rail, a frame, a first shade, and a second shade positioned rearward of the first shade. The frame may include opposing side members defining opposing, vertically-extending channels. The frame also may include a bottom member extending between the opposing side members and defining a horizontally-extending channel. The first shade may be positioned forward of the side members. The first shade also may be positioned forward of the bottom member. The first shade may be suspended from the head rail. The first shade may be operably coupled to the roller so that rotation of the roller in a retraction direction gathers the first shade adjacent the head rail. The second shade may be positioned rearward of the first shade. The second shade may be slidably received within the channels of the side members. The second shade also may be slidably received within the channel of the bottom member. The second shade may be operably coupled to the roller so that rotation of the roller in the retraction direction wraps the second shade around the roller.

In a further example, the covering may include a single rotatable roller, a first shade operably coupled to the roller, and a second shade operably coupled to the roller. The first and second shades may be movable across an architectural opening in unison. The covering may further include a plurality of retainers and a flexible strip of material. The plurality of retainers may be removably coupled to the first shade at vertically-spaced locations. The strip of material may have an upper end portion and a lower end portion. The upper end portion may be coupled to the roller. The lower end portion may be coupled to a lowermost retainer of the plurality of retainers. The strip of material may be slidably positioned between the first shade and a remainder of the plurality of retainers. The strip of material may be wrappable about the roller. The second shade may be wrappable about the roller. When the roller is rotated in a retraction direction, corresponding lengths of the strip of material and the second shade may wrap about the roller.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of examples, it should be appreciated that individual aspects of any example can be claimed separately or in combination with aspects and features of that example or any other example.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary. Moreover, reference made herein to "the present invention" or aspects thereof should be understood to mean certain examples of the present disclosure and should not necessarily be construed as limiting all examples to a particular description.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

FIG. 5 is a rear isometric view of the covering system of FIG. 1 with the shade in the fully-extended position illustrated in FIG. 3A with a rear shade member partially removed for illustrative purposes.

FIG. 6 is an enlarged view of the covering system of FIG. 1 taken along the line 6-6 illustrated in FIG. 5.

FIG. 9 is an enlarged view of the covering system of FIG. 1 taken along the line 9-9 illustrated in FIG. 7A.

FIG. 10 is a front isometric view of a retainer of the covering system of FIG. 1. The retainer is illustrated in various shade positions in FIGS. 5-7B, 9, 12, and 13.

FIG. 11 is a cross-section view of the covering system of FIG. 1 taken along the line 11-11 illustrated in FIG. 9.

Figure 1:
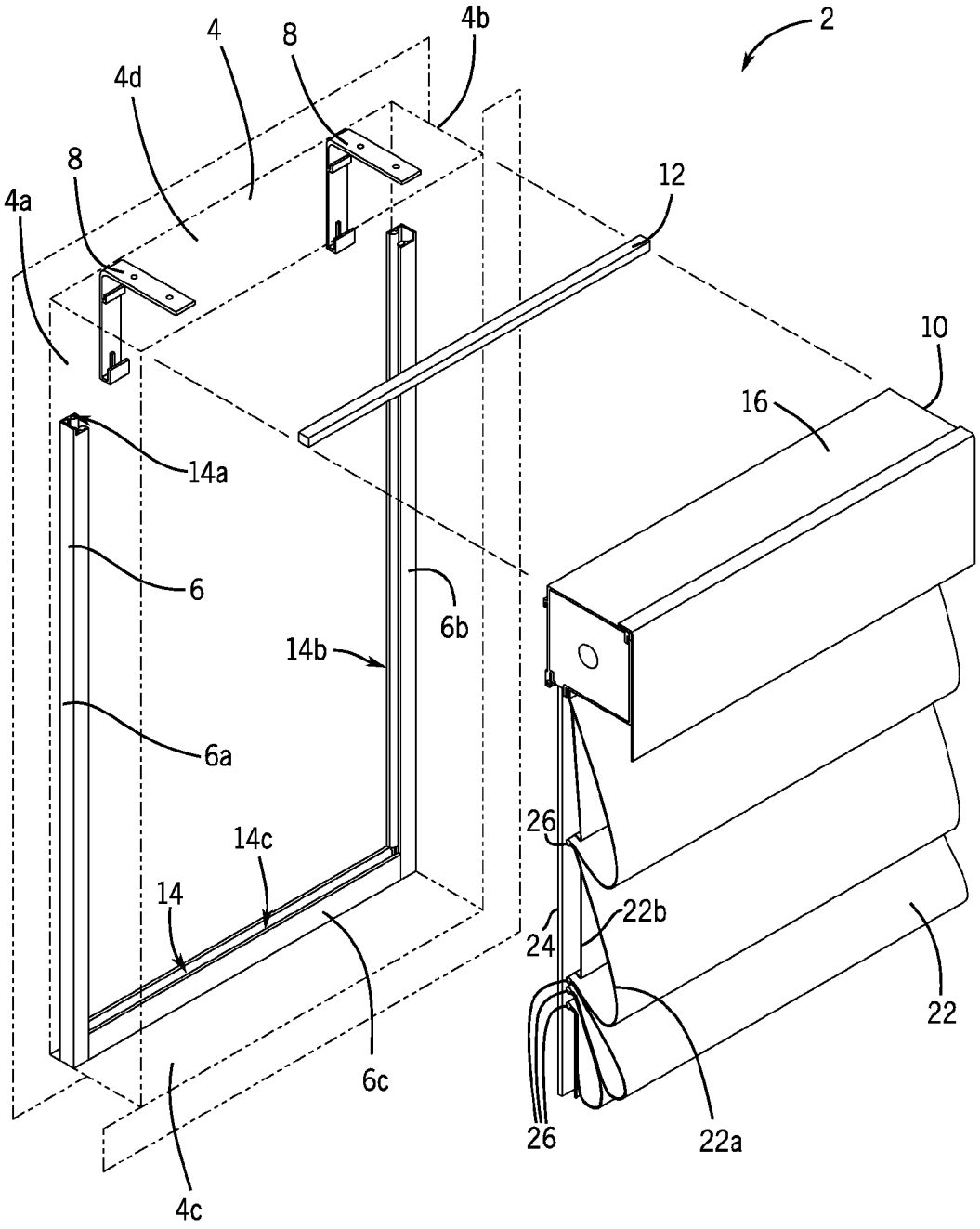
FIG. 1 is a front or room side isometric view of a partially exploded example sound attenuating covering system.

It should be understood that the drawings are not necessarily to scale. In certain instances, details that are not necessary for an understanding of the disclosure or that render other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. It should be understood that the claimed subject matter is not necessarily limited to the particular examples or arrangements illustrated herein.

DETAILED DESCRIPTION

The present disclosure provides a sound attenuating covering for an architectural opening. The covering may reduce or minimize exterior sound penetrating into a room through an architectural opening. The efficacy of the covering has been tested in connection with single pane windows and resulted in about a one-half reduction in sound penetrating through the architectural opening. The covering may be used with any type of architectural opening.

The covering may include at least two shades. One of the shades may provide an acoustic barrier or screen configured to substantially reduce the amount of sound penetrating through the architectural opening. Another of the shades may be positioned on a room side of the acoustic barrier or screen and may provide additional sound attenuation as well as serving an aesthetical function. The at least two shades may be any type of shade that provides a suitable sound attenuation function, aesthetic function, or both. Types of shades include cellular shades, roller shades, Roman shades, other suitable shades, and any combination thereof.

The at least two shades may move in conjunction with one another across the architectural opening. For example, the at least two shades may be simultaneously or substantially simultaneously wrappable about a roller. In one example, the at least two shades includes a roller shade and a stacking Roman shade. In this example, the roller shade and at least one lift element associated with the Roman shade may be simultaneously or substantially simultaneously wrappable about a roller, which may be a single roller or separate rollers configured to lift the different shades simultaneously or substantially simultaneously. The simultaneous or substantially simultaneous wrapping about or unwrapping from a roller may result in a uniform movement of the shades across an architectural opening.

The covering may be associated with a frame attached to the architectural opening. The frame may be configured to substantially block or seal any gaps between peripheral edges of a shade and the architectural opening, thereby at least partially removing or mitigating sound leakage paths around the shade. The frame may include multiple frame members, such as opposing side frame members and a bottom frame member. Sealing elements may be used to effectively seal any air gaps between the frame and the architectural opening, the frame members themselves, the frame and the peripheral edges of the shade, and many other connections or joint.

Figure 2:
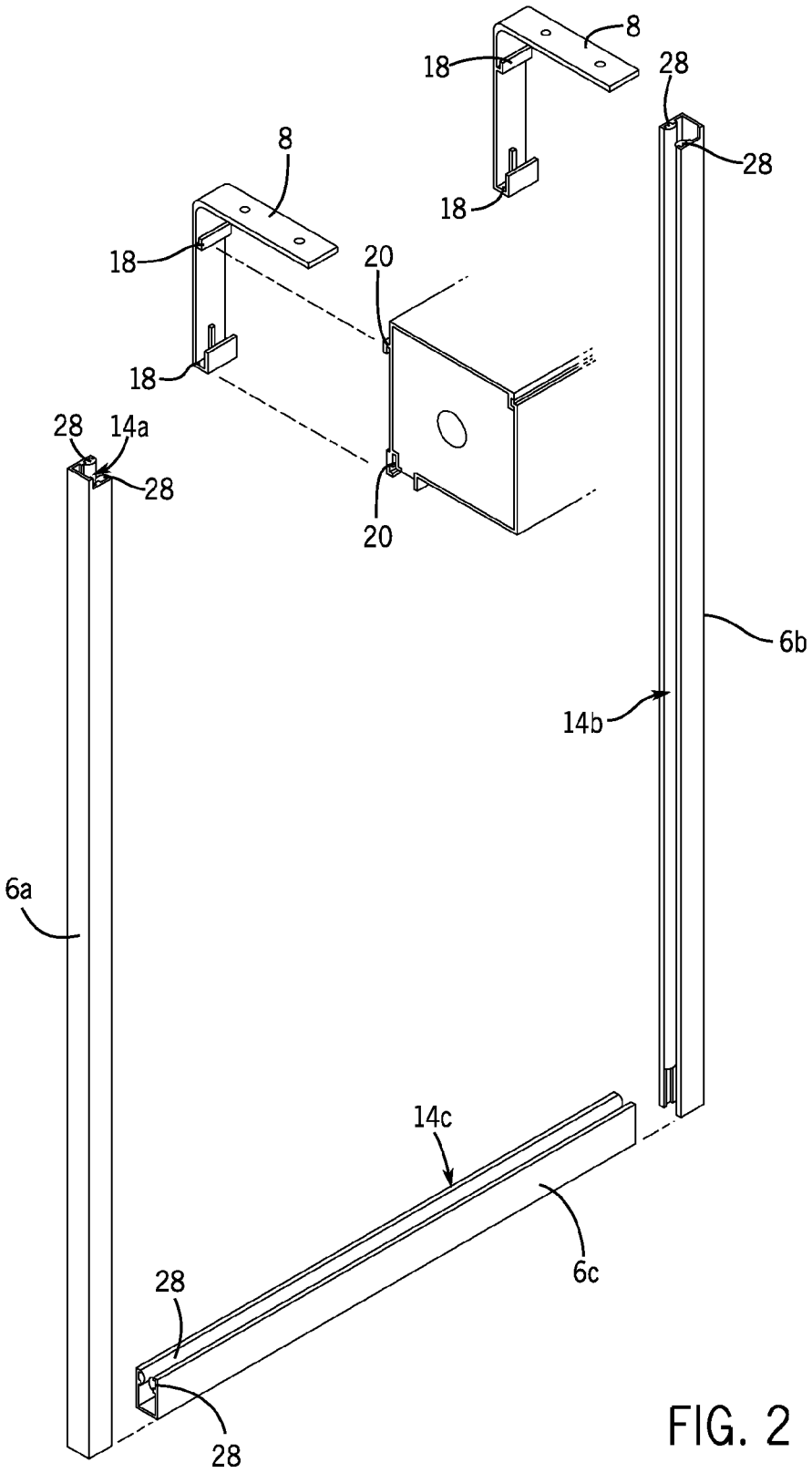
FIG. 2 is an exploded, front isometric view of a frame, mounting brackets, and a partial head rail of the covering system of FIG. 1.

Referring to FIG. 1, a covering system 2 for an architectural opening, such as a window opening 4, is provided. The covering system 2 may include a frame 6 and a retractable covering 10. With reference to FIGS. 1-2, the frame 6 may include opposing side frame members 6*a*, 6*b* and a bottom frame member 6*c* interconnecting lower ends of the side frame members 6*a*, 6*b*. The side frame members 6*a*, 6*b* may be attached to corresponding sides 4*a*, 4*b* of the window opening 4 and may extend from a base 4*c* of the window opening 4 toward a top 4*d* of the window opening 4. The side frame members 6*a*, 6*b* may have a length that is shorter than a length of the corresponding sides 4*a*, 4*b* to define a vertical space between the side frame members 6*a*, 6*b* and the top 4*d* of the window opening configured to receive a head rail 16 of the retractable covering 10. The bottom frame member 6*c* may be attached to a corresponding base 4*c* of the window opening 4 and may extend substantially perpendicular to the side frame members 6*a*, 6*b*. The frame members 6*a*-6*c* may be attached to corresponding sides 4*a*-4*c* of the window opening 4 (see FIG. 1) or may be embedded within the sides 4*a*-4*c* such that the frame members 6*a*-6*c* are substantially concealed from view.

With continued reference to FIGS. 1-2, each frame member 6*a*-6*c* may define a lengthwise-extending, inwardly-directed channel 14*a*-14*c*. When the frame members 6*a*-6*c* are assembled (FIG. 1), the respective channels 14*a*-14*c* may form a continuous, inwardly-directed channel 14. Sealing elements may be positioned between or immediately adjacent connection lines between the respective frame members 6*a*-6*c* and the sides 4*a*-4*c* of the window opening 4 to substantially prevent any air gaps. Each frame member 6*a*-6*c* may be constructed of extruded c-channels.

A pair of mounting brackets 8 may be attached to the top 4*d* of the window opening 4 and may be configured to support the head rail 16 beneath the top 4*d* of the window opening 4. The brackets 8 may be substantially identical to one another and may be spaced apart from one another along the top 4*d* of the window opening. Each bracket 8 may include a pair of vertically-spaced, upturned lips 18 configured to seat within downwardly-opening slots 20 defined in the head rail 16 (see FIG. 2). In this manner, the head rail 16 of the covering 10 may be removably attached to the mounting brackets 8. Other mounting techniques known in the art, such as different mounting brackets and/or head rail configurations, may be used to attach the covering 10 to the top 4*d* and/or sides 4*a*, 4*b* of the window opening 4.

With continued reference to FIG. 1, the retractable covering 10 may include the head rail 16, a first or front shade 22 suspended from the head rail 16, and a second or rear shade 24 suspended from the head rail 16. The first shade 22 may be a Roman shade or any other suitable shade. The first shade 22 is depicted as a Roman shade and includes a front sheet 22*a* and a rear sheet 22*b* attached together at a plurality of vertically-spaced locations to define a plurality of horizontally-extending, vertically-spaced, rearwardly-directed pleats 26. Between vertically consecutive pleats, the front sheet 22*a* may have a longer length than the rear sheet 22*b*, resulting in the rear sheet 22*b* being in a substantially taut condition and the front sheet 22*a* forming horizontally-extending, vertically-spaced, forwardly-directed cascading droops. The front and rear sheets 22*a*, 22*b* may form a plurality of elongated, vertically-aligned, horizontally-extending, transversely-collapsible cellular units. The front and rear sheets 22*a*, 22*b* each may be constructed of continuous lengths of material or may be constructed of strips of material attached or joined together in an edge-to-edge, overlapping, or other suitable relationship.

The first shade 22 may be constructed of substantially any type of material. For example, the first shade 22 may be constructed from natural and/or synthetic materials, including fabrics, polymers, and/or other suitable materials. Fabric materials may include woven, non-woven, knits, or other suitable fabric types. In one example, the front and rear sheets 22*a*, 22*b* are constructed of flexible material. In one example, the first sheet 22*a* is a relatively heavy, woven fabric and the second sheet 22*b* is a relatively light, woven fabric. The first shade 22 may have any suitable level of light transmissivity. For example, the first shade 22, including the front and rear sheets 22*a*, 22*b*, may be constructed of transparent, translucent, and/or opaque materials. In one example, the front sheet 22*a* is constructed of an opaque material and the rear sheet 22*b* is constructed of a translucent material.

The second shade 24 may be positioned rearwardly of the first shade 22 and may be substantially planar when in an extended position. The second shade 24 may be constructed of a sound attenuating material, such as a sound absorbing or reflecting material. Suitable materials may include, but are not limited to, fabrics (e.g., woven, non-woven, knits, or other suitable fabrics), foams (e.g., open-celled and closed-celled foams, melamine foam, and other suitable foams), gels (e.g., aerogels, hydrogels, and other suitable gels), polymers (e.g., polyacrylates, polyamides, polyarylenes, polycarbonates, polycyanurates, polyesters, polyethylene, polyimides, polypropylene, polystyrene, polysulfones, polyureas, polyurethane, rubber, vinyl, and other suitable polymers), other suitable sound attenuating materials, and mixtures of two or more of any of the foregoing. Cross-linking reagents may be used to form cross-links in a polymer material. In some examples, the second shade 24 is a mass loaded vinyl. In some examples, the second shade 24 is formed as a foam-like material layer and a film-like material layer, such as foam covered by or laminated with a vinyl layer. The foam layer may be relatively porous, and the vinyl layer may be relatively continuous without significant porosity. The vinyl layer may be about four millimeters thick, although any other suitable thickness may be used. The second shade 24 may have any suitable level of light transmissivity. For example, the second shade 24 may be constructed of transparent, translucent, and/or opaque materials. In one example, the second shade 24 is constructed of an opaque material.

With reference to FIGS. 1-2, the head rail 16 may be removably secured to the mounting brackets 8 and positioned between the upper ends of the side frame members 6*a*, 6*b*. A sealing element 12 may be positioned between an upper surface of the head rail 16 and the top 4*d* of the window opening 4 to substantially prevent any air gap there between. The sealing element 12 may extend around opposing ends of the head rail 16 and be positioned between the ends of the head rail 16 and the sides 4*a*, 4*b* of the window opening 4 to substantially prevent any air gap there between. The sealing element 12 may be formed from foam, rubber, or any other suitable sound attenuating material.

Figure 3A:
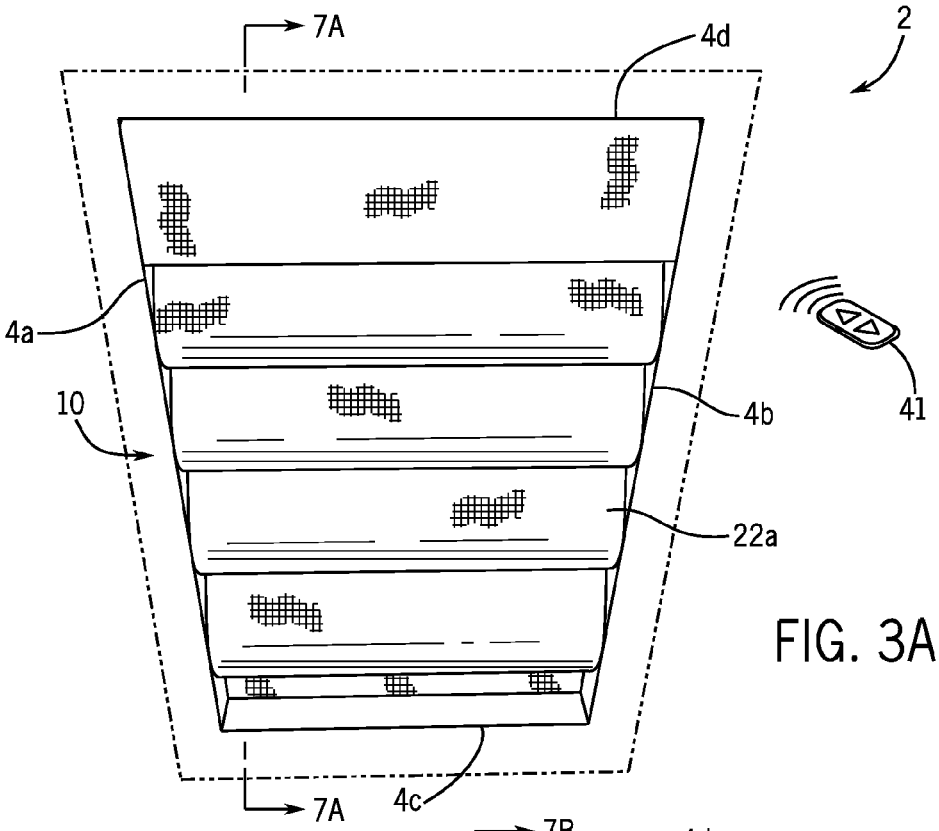
FIG. 3A is a front isometric view of the covering system of FIG. 1 with the shade in a fully-extended position.

With reference to FIGS. 3A-4B, the first and second shades 22, 24 are illustrated in various operational positions. The first shade 22 may be positioned forward of the frame 6 and the rearwardly-directed pleats 26 may abut or ride along front faces of the frame members 6*a*-6*c*. The second shade 24 may be slidably received within the side frame members 6*a*, 6*b* so that the side frame members 6*a*, 6*b* act as guides for opposing sides of the second shade 24. With reference to FIGS. 3A and 4A, the first and second shades 22, 24 are illustrated in a fully-extended position in which the first and second shades 22 may extend across substantially the entire length and width of the window opening 4. As illustrated in FIG. 3A, the first shade 22 may substantially conceal the frame 6 from a front or room-side view of the window opening 4. As illustrated in FIG. 4A, the second shade 24 and the frame 6 may substantially conceal the first shade 22 from a rear or road-side view of the window opening 4.

Figure 4A:
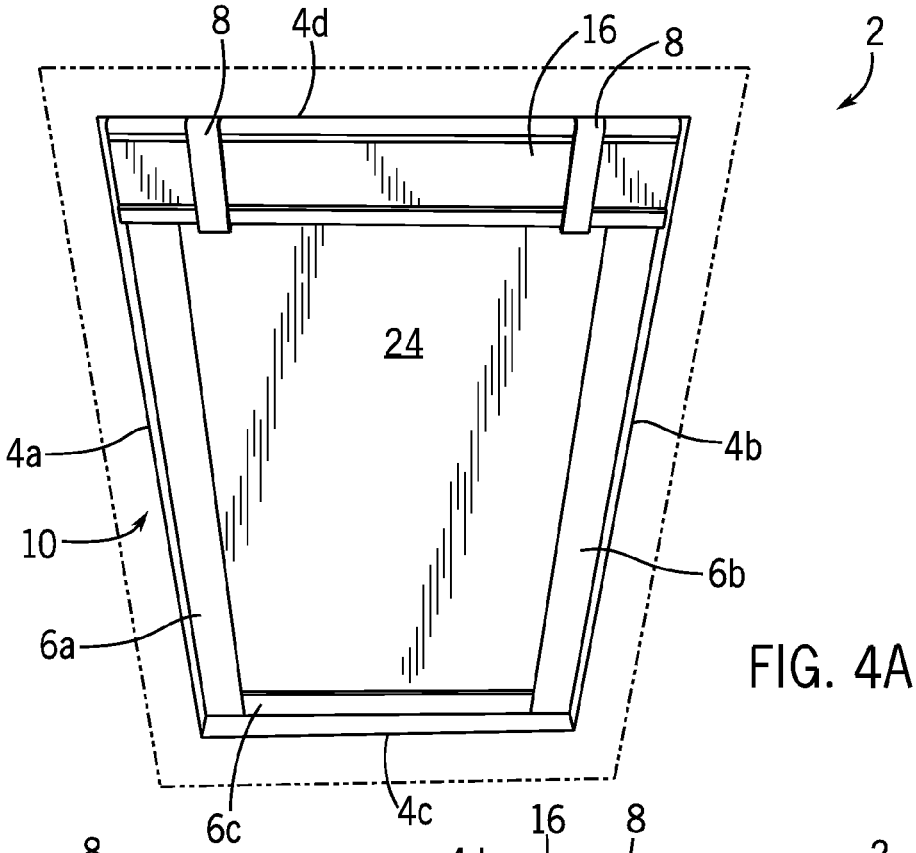
FIG. 4A is a rear or road side isometric view of the covering system of FIG. 1 with the shade in the fully-extended position illustrated in FIG. 3A.

When the retractable covering 10 is in the fully-extended position illustrated in FIGS. 3A and 4A, the covering system 2 may substantially reduce sound penetration or transmission from outside sources through the window opening 4 into a corresponding room. Any joints between the side frame members 6*a*-6*c* and the side frame members 6*a*-6*c* and the sides 4*a*-4*b* and the base 4*c* of the window opening 4 may be effectively sealed by the use of sealing elements. Similarly, any joints between the head rail 16 and the sides 4*a*, 4*b* and the top 4*d* of the window opening 4 may be effectively sealed by the use of sealing elements, such as the sealing element 12. Further, any gaps between the second shade 24 and the frame members 6*a*-6*c* may be effectively sealed by the used of seal strips 28 coupled to the frame members 6*a*-6*c* (see FIG. 2), which will be discussed in more below.

Figure 7A:
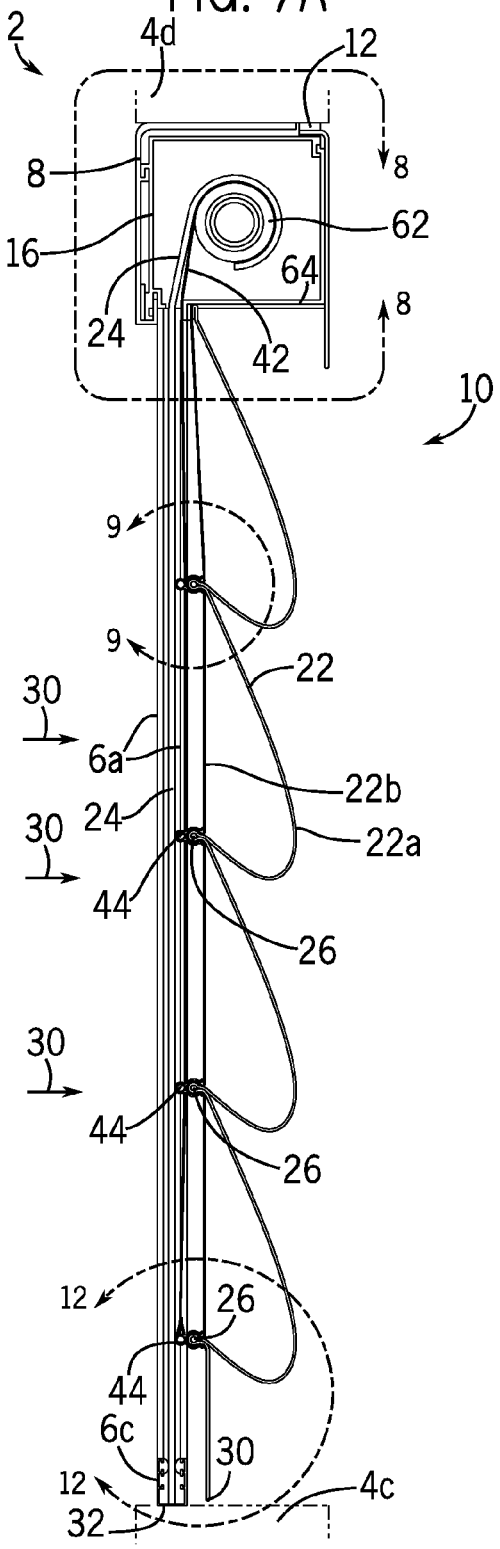
FIG. 7A is a cross-section view of the covering system of FIG. 1 taken along the line 7A-7A illustrated in FIG. 3A.
Figure 12:
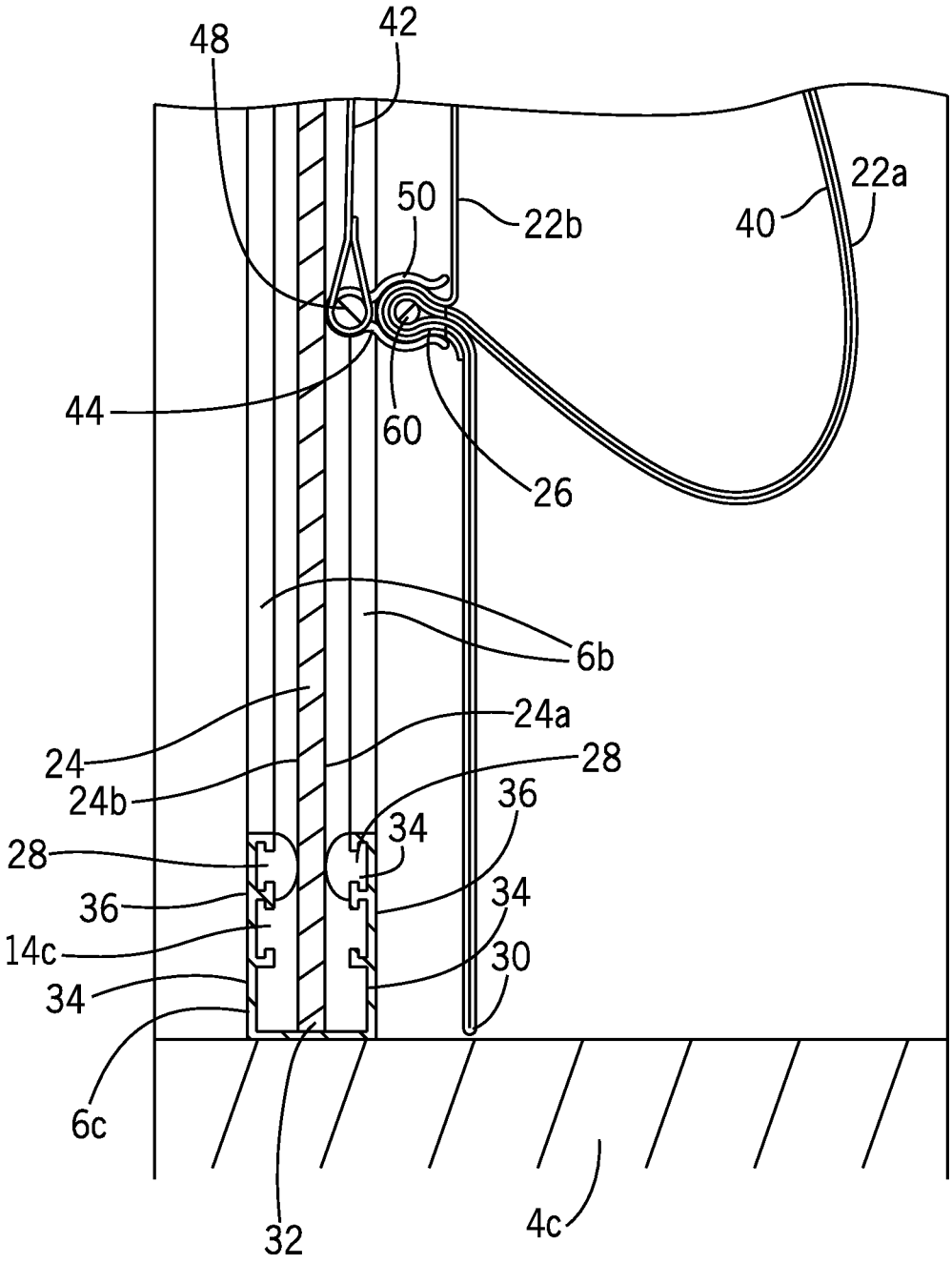
FIG. 12 is an enlarged view of the covering system of FIG. 1 taken along the line 12-12 illustrated in FIG. 7A.

With reference to FIG. 7A, a cross-section view of the covering system 2 of FIG. 1 taken along the line 7A-7A illustrated in FIG. 3A is provided. In FIG. 7A, the first and second shades 22, 24 are extended into a fully-extended position in which lower edges 30, 32 of the first and second shades 22, 24 may be adjacent a base 4*c* of the window opening 4. The second shade 24 is positioned rearward of the first shade 22 toward a road-side of the window opening. With reference to FIG. 12, the lower edge portion 32 of the second shade 24 is positioned within the channel 14*c* of the bottom frame member 6*c* and positioned transversely between two seal strips 28 received within horizontally-extending receptacles 34 defined in opposing side walls 36 of the bottom frame member 6*c*. The opposing seal strips 28 may contact opposing faces 24*a*, 24*b* of the second shade 24 to substantially eliminate any air gap between the lower edge portion 32 of the second shade 24 and the bottom frame member 6*c*. Although not depicted, a ballast bar may be associated with a lower end portion of the first shade 22, the second shade 24, or both to maintain the first shade 22, the second shade 24, or both in a substantially taut condition and to assist in extending the first shade 22, the second shade 24, or both across the window opening 4.

With reference to FIG. 11, opposing side edge portions 38 of the second shade 24 may be positioned within the channels 14*a*, 14*b* of the side frame members 6*a*, 6*b* and transversely between two seal strips 28 received within vertically-extending receptacles 34 defined in opposing side walls 36 of the side frame members 6*a*, 6*b* (only one of the side frame members 6*b* is depicted for brevity purposes as side frame members 6*a*, 6*b* may be substantially identical to one another). The opposing seal strips 28 may contact opposing faces 24*a*, 24*b* of the second shade 24 to substantially eliminate any air gap between the side edge portions 38 of the second shade 24 and the side frame members 6*a*, 6*b*. As such, the seal strips 28 may form a seal line around a periphery of the front and rear faces 24*a*, 24*b* of the second shade 24. Each frame member 6*a*-6*c* may include a second set of receptacles 34 (or more) configured to receive additional sets of opposing seal strips 28.

The seal strips 28 may constructed of any suitable acoustic absorbing or reflecting material. In one example, the seal strips 28 are constructed of foam or rubber and may include a low-friction coating (such as polytetrafluoroethylene) to reduce frictional forces between the second shade 24 and the seal strips 28. In another example, the seal strips 28 are constructed of a textile comprising an upper layer of fibers (such as nylon, polyester, polypropylene, or other suitable fibers) attached to a backing (such as a plastic strip). The fibers may be formed as twisted tufts.

With reference back to FIG. 7A, as sound waves 30 propagate toward the window opening 4 from sources external to an associated room, the sound waves 30 may first encounter the second shade 24, which as previously discussed may be constructed of sound absorbing or reflecting materials. The second shade 24 may be constructed of a generally high density material (resulting in a higher mass relative to low- to mid-density materials), and thus the second shade 24 may substantially attenuate lower frequency sound waves. Further, the second shade 24 may be laminated with a sound blocking material to redirect or reflect some of the sound waves 30 away from the window opening 4.

Some of the sound waves 30 may pass through the second shade 24 (some with reduced amplitude) and then encounter the first shade 22. The rear sheet 22*b* of the first shade 22 may be constructed of a low- to mid-density material and may be in a substantially taut condition (see FIG. 7A). Thus, the rear sheet 22*b* may substantially attenuate higher frequency sound waves. The front sheet 22*a* of the first shade 22 may be a generally heavy, woven fabric with a relatively high mass. Thus, the front sheet 22*a* of the first shade 22 may substantially attenuate lower frequency sound waves.

In some examples, the front sheet 22*a* may include an intermediate sheet 40 laminated or otherwise secured to a rear or inner surface of the front sheet 22*a* (see FIGS. 9 and 12). The intermediate sheet 40 may be a non-woven material, which may be generally lightweight, soft, and include fuzzy protuberances. The intermediate sheet 40 may be configured to attenuate higher frequency sound waves. As such, sound waves 30 generated exterior to a window opening 4 may encounter a first sound blocking medium (e.g., a sound blocking material laminated to the rear face 24*b* of the second shade 24), a first lower-frequency attenuating medium (e.g., the second shade 24), a second sound blocking medium (e.g., a sound blocking material laminated to the front face 24*a* of the second shade 24), a first higher-frequency attenuating medium (e.g., the rear sheet 22*b* of the first shade 22), a second higher-frequency attenuating medium (e.g., the layer 40 laminated to a rear or inner surface of the front sheet 22*a*), and a second lower-frequency attenuating medium (e.g., the front sheet 22*a* of the first shade 22). This configuration of the retractable covering 10 may reduce the transmitted sound by half as compared to a window opening with no retractable covering 10 (see test data below).

With reference back to FIGS. 3A-4B, the retractable covering 10 may be movable between various operational positions. The retractable covering 10 may include an operating system or drive mechanism configured to raise or retract the first and second shades 22, 24. The operating system may include a crank, an electrical motor, a spring, an operating element (such as a cord or ball chain) operably coupled to a pulley, or any other suitable drive element or mechanism. If the retractable covering 10 is motorized, the covering 10 may include a transceiver operable to communicate with a transmitter, such as a remote control unit 41 (see FIGS. 3A-3B), or may be electrically coupled to a wall switch. As such, the covering 10 may be operated mechanically, electrically, or both.

With reference to FIG. 5, the retractable covering 10 may include a lift assembly having at least one flexible, vertically-extending strip of material 42 operably coupled to a rear face of the first shade 22 to retract or extend the first sheet 22 across the window opening. In FIG. 5, the retractable covering 10 includes two strips of material 42 extending lengthwise along a rear side of the first shade 22 and laterally spaced apart from each other. The strip of material 42 may comprise a generally thin, flat strap with a substantially uniform width. The strip of material 42 may be a woven fabric, such as a substantially flat, flexible strip of webbing. The strip of material 42 may have any suitable level of light transmissivity. For example, the strip of material 42 may be constructed of transparent, translucent, and/or opaque materials. In one example, the strip of material 42 is substantially transparent. In one example, the strip of material 42 is a substantially flat strip of dimensionally stable and transparent film.

With reference to FIGS. 5 and 6, the strip of material 42 may slidably extend between the first shade 22 and a series of retainers 44 removably attached to the rearwardly-directed pleats 26 of the first shade 22. For each strip of material 42, a substantially vertically-aligned column of retainers 44 may be attached to the first shade 22. Each retainer 44 may define a bounded passage through which the strip of material 42 may extend. The passage defined by the retainer 44 and a corresponding pleat 26 may be sized such that the strip of material 42 is vertically slidable through the passage with limited lateral movement. Each strip of material 42 may be attached to a lowermost retainer 44, such as by inserting a portion of the lowermost retainer 44 through a pocket defined by a hemmed, lower end portion 46 of the strip of material 42. As such, each strip of material 42 may be attached to the first shade 22 through a lowermost retainer 44 and may be slidably extended through a plurality of other retainers, which may act as guides to retain the strip of material 42 in an adjacent or abutting relationship with the rearwardly-directed pleats 26 of the first shade 22.

An isometric view of a retainer 44 is provided in FIG. 10. With reference to FIG. 10, the retainer 44 includes an elongated cross bar 48 and a pair of substantially identical, resilient clips 50 mounted around opposing end portions 48*a*, 48*b* of the cross bar 48. Each clip 50 may have a pair of free ends 50*a*, 50*b* spaced apart from one another to define an entrance 52. In transverse cross-section, each clip 50 may define a first arcuate or curved portion 54 that integrally transitions into a second arcuate or curved portion 56. The first and second arcuate portions 54, 56 may define two axially-extending, contiguous inner spaces 54*a*, 56*a*, respectfully, separated from one another by an axially-extending, constricted throat space 58. The inner space 54*a* defined by the first arcuate portion 54 may be larger in transverse cross-section than the inner space 56*a* defined by the second arcuate portion 56. The inner space 54*a* defined by the first arcuate portion 54 may open directly to the entrance 52 while the inner space 56*a* defined by the second arcuate portion 56 may open indirectly to the entrance 52 through the throat space 58 and the inner space 54*a*.

With continued reference to FIG. 10, an end portion 48*a* or 48*b* of the cross bar 48 may be positioned within the inner space 56*a* of the second arcuate portion 56 of a clip 50. The respective end portion 48*a*, 48*b* may be interference fit within the clip 50. That is, the second arcuate portion 56 of each clip 50 may apply a compressive force to a respective end portion 48*a*, 48*b* of the elongated cross bar 48, thereby creating a friction force securing the clips 50 to the cross bar 48. Additionally or alternatively, the clips 50 may adhered, welded, or otherwise secured to the cross bar 48.

With reference to FIG. 11, the first arcuate portion 54 of each clip 50 may be removably secured to a rearwardly-directed pleat 26 defined by the first shade 22. Each pleat 26 may include a section of the rear sheet 22*b*, the laminate layer 40, and the front sheet 22*a* hemmed around an elongate ballast bar 60 extending substantially horizontally and widthwise along the first shade 22. The entrance 52 of each clip 50 may be smaller than an outer dimension of the pleat 26 so that the first arcuate portion 54 resiliently deforms upon insertion of the pleat 26 into the inner space 54*a* of the first arcuate portion 54. Similar to the entrance 52, the second arcuate portion 56 of each clip 50 may be smaller than an outer dimension of the pleat 26 so that once the pleat 26 is received within the inner space 54*a*, the second arcuate portion 56 of each clip 50 may apply a compressive force to the pleat 26 sufficiently strong to ensure that the clips 50 do not inadvertently detach from the pleats 26 during retraction and extension of the first shade 22.

Figure 7B:
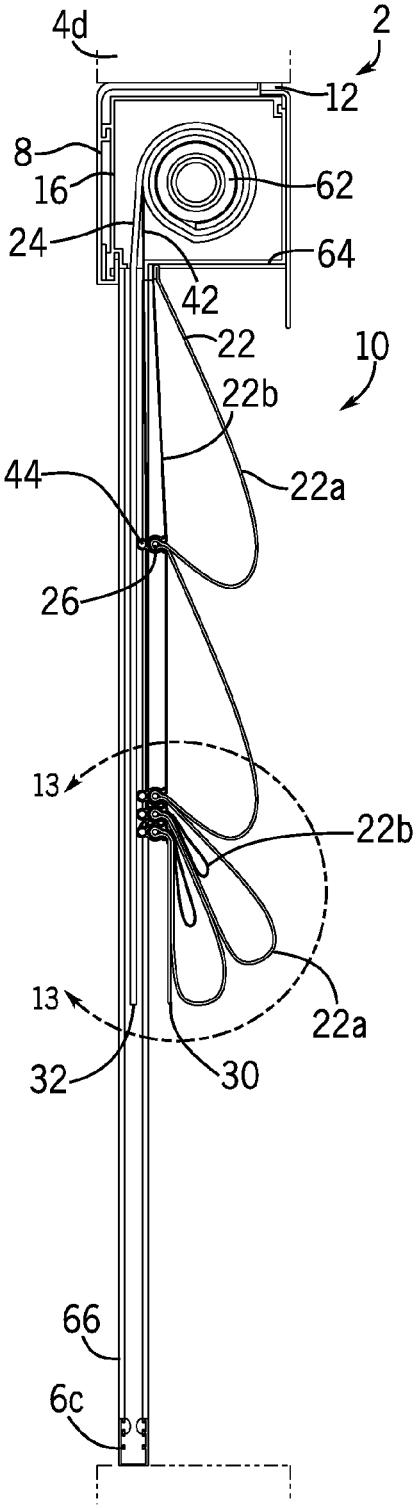
FIG. 7B is a cross-section view of the covering system of FIG. 1 taken along the line 7B-7B illustrated in FIG. 3B.
Figure 8:
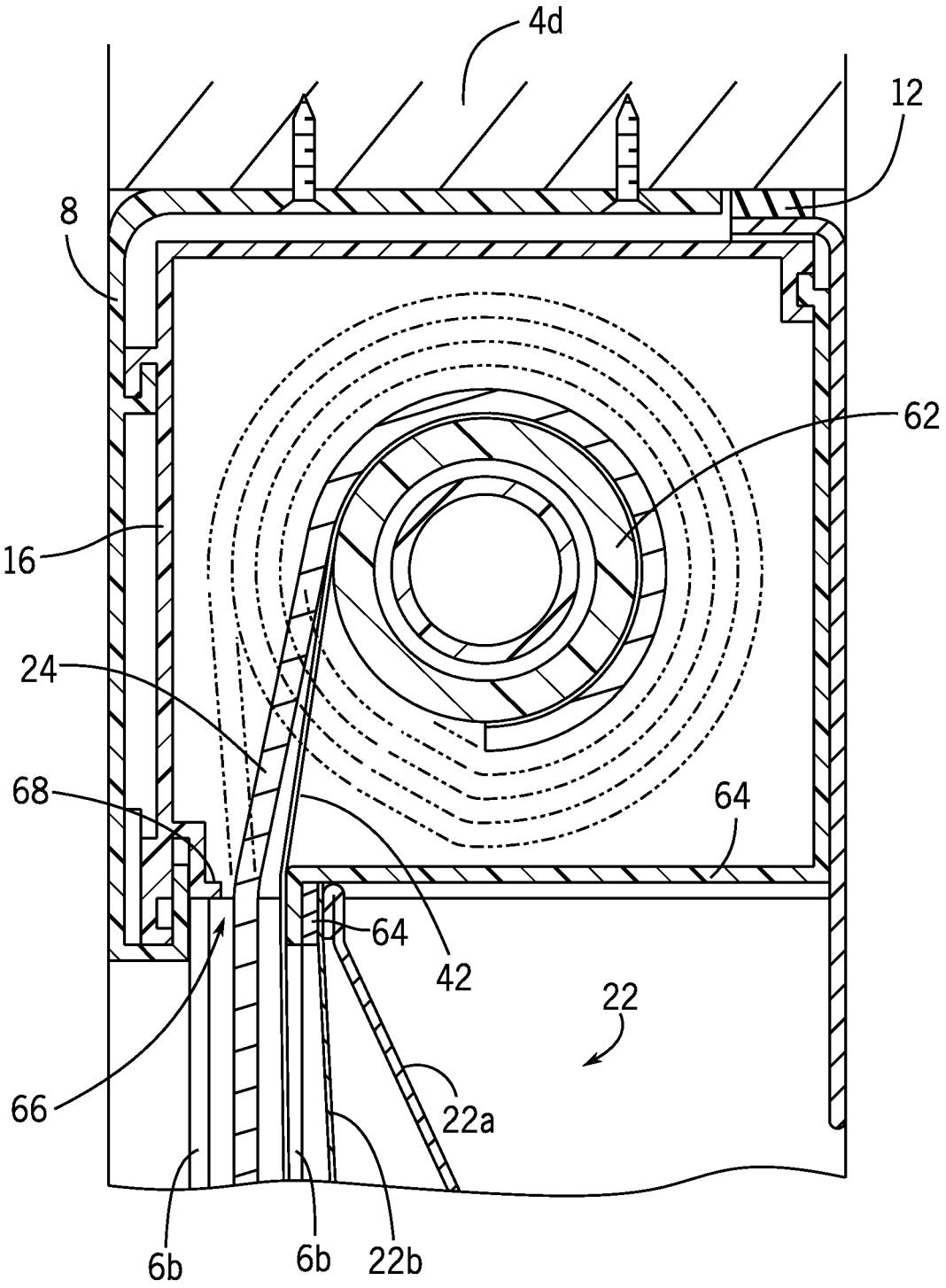
FIG. 8 is an enlarged view of the covering system of FIG. 1 taken along the line 8-8 illustrated in FIG. 7A.

With reference to FIGS. 7A-8, an elongated, rotatable roller 62 may be housed within the head rail 16. The first and second shades 22, 24 may be operably associated with the roller 62 so that rotational movement of the roller 62 about a longitudinally-extending axis moves the shades 22, 24 between extended and retracted positions. Rotation of the roller 62 in a first direction may retract the shades 22, 24 to a position adjacent one or more sides of an associated architectural opening and rotation of the roller 62 in a second, opposite direction may extend the shades 22, 24 across the opening.

The front and rear sheets 22*a*, 22*b* may be suspended from the head rail 16. As illustrated in FIGS. 7A-8, an upper end portion of the front and rear sheets 22*a*, 22*b* of the first shade 22 may be attached to the head rail 16 with a fastener 64 (such as adhesive, hook and loop fasteners, or other suitable attachment means), which may extend substantially horizontally along a lower portion of the head rail 16 in a continuous or discontinuous manner. The front and rear sheets 22*a*, 22*b* may extend in a downward direction from the attachment point.

To effect movement of the front and rear sheets 22*a*, 22*b*, an upper end portion of each strip of material 42 may be attached to the roller 62 in a conventional manner, such as by adhesive. The strips of material 42 may be wrapped about or unwrapped from the roller 62 depending upon the direction of rotation of the roller 62. For example, during retraction of the retractable covering 10, each strip of material 42 may be wrapped about the roller 62 (see FIGS. 7A-7B in order). The upward movement of each strip of material 42 may raise the lowermost retainer 44 (see FIGS. 7A and 12) in an upward direction, which in turn may raise the front and rear sheets 22*a*, 22*b* of the first shade 22 through the hemmed attachment of each strip of material 42 to the cross bar 48 of the lowermost retainer 44. The weight of the first shade 22 may maintain the strip of material 42 in a substantially taut condition during extension and retraction of the first shade 22, and thus the strips of material 42 may maintain the pleats 26 in a single, substantially vertical plane during extension and retraction, which may provide an improved appearance of the front sheet 22*a* of the first shade 22 during extension and retraction.

Figure 13:
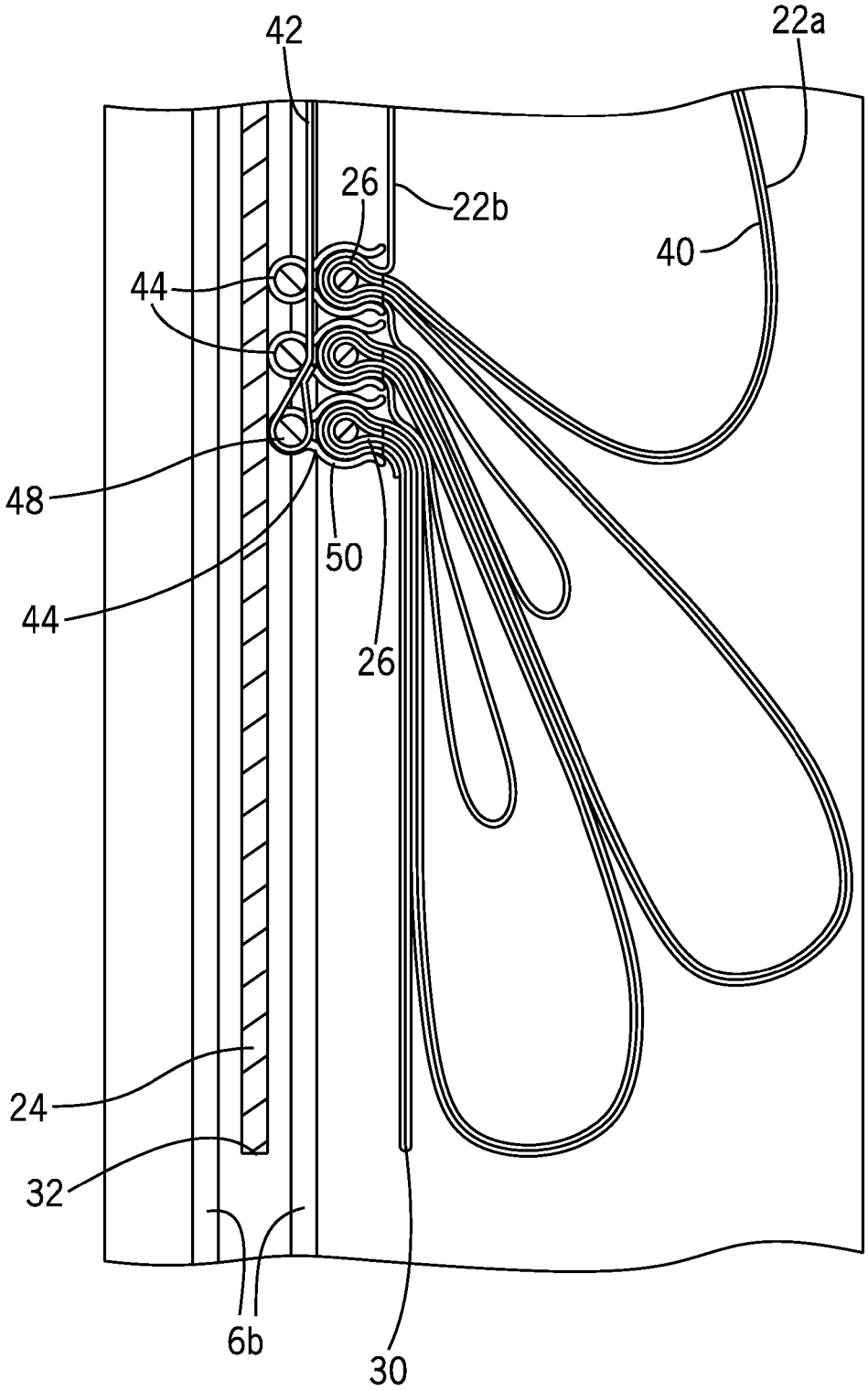
FIG. 13 is an enlarged view of the covering system of FIG. 1 taken along the line 13-13 illustrated in FIG. 7B.

As each strip of material 42 is wrapped about the roller 62, the lowermost retainer 44 may pull the front and rear sheets 22*a*, 22*b* upwards along with the other retainers 44, which may progressively stack on top of the lowermost retainer 44 in a substantially vertical alignment (see FIGS. 7B and 13). In a retracted state (see FIGS. 1, 7B, and 13), the front and rear sheets 22*a*, 22*b* may collapse such that the rear sheet 22*b* forms a plurality of smaller loops each positioned within a larger loop formed by the front sheet 22*a*. The upward movement may continue until the retractable covering 10 is in a fully retracted state in which the front and rear sheets 22*a*, 22*b* are gathered beneath or below a lower wall 64 of the head rail 16.

During extension of the retractable covering 10, each strip of material 42 may be unwrapped from the roller 62 (see FIGS. 7A-7B in reverse order). The downward movement of each strip of material 42 may lower the lowermost retainer 44 (see FIGS. 7A and 12) in a downward direction due at least in part to the weight of front and rear sheets 22*a*, 22*b* of the first shade 22 pulling downward on the cross bar 48 of the lowermost retainer 44. The lowering of the lowermost retainer 44 may extend the front and rear sheets 22*a*, 22*b* of the first shade 22 across the window opening 4. As each strip of material 42 continues to be unwrapped from the roller 62, the retainers 44 may progressively vertically separate from one another until portions of the rear sheet 22*b* between subsequent pleats 26 are extended into a taut condition. Once the rear sheet 22*b* is in a substantially taut condition, the retainers 44 may be substantially uniformly spaced in a lengthwise direction along a rear face of the rear sheet 22*b*.

Similar to the strips of material 42, the second shade 24 may be wrappable about the roller 62 (see FIGS. 7A-8). During retraction of the retractable shade 10, the second shade 24 may wrap around the roller 62. During extension of the retractable shade 10, the second shade 24 may unwrap from the roller 62. With reference to FIG. 8, the strips of material 42 and the second shade 24 may extend through an opening 66 formed in the lower wall 64 of the head rail 16 and converge from that point towards a periphery of the roller 62. Although not illustrated, seal strips 28 may be attached to opposing sides of the opening 66 to minimize air leakage through the opening 66. Additionally or alternatively, the second shade 24 may be in abutting relationship with an inturned lip 68 of the head rail 16 (such as by extending the lip 68 forward or moving the shade 24 rearward) to substantially eliminate any air gap between the lip 68 and the second shade 24. The strips of material 42 and the second shade 24 may extend from a common side of the roller. For example, the strips of material 42 and the second shade 24 may extend from a rear side of the roller (FIGS. 7A-8) or a front side of the roller.

The first shade 22 and the second shade 24 may extend or retract in unison and may form alternating layers of the strips of material 42 and the second shade 24 around a periphery of the roller 62. With reference to FIGS. 7A-8, the strips of material 42 and the second shade 24 may be simultaneously wrapped around or unwrapped from the roller 62 to effect simultaneous movement of the first and second shades 22, 24. As the roller 62 is rotated in a retraction direction, corresponding lengths of the strip of material 42 and the second shade 24 may wrap about the roller 62, resulting in the first and second shades 22, 24 being simultaneously raised in unison a substantially equivalent distance. As the roller 62 is rotated in an extension direction, corresponding lengths of the strip of material 42 and the second shade 24 may unwrap from the roller 62, resulting in the first and second shades 22, 24 being simultaneously lowered in unison a substantially equivalent distance.

Figure 3B:
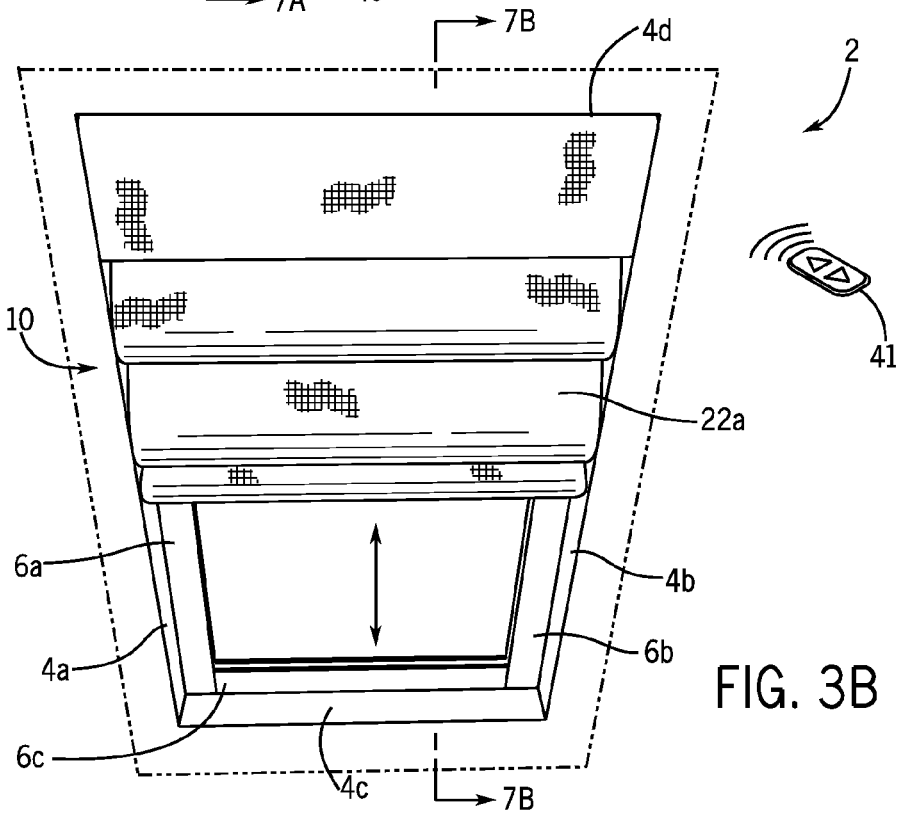
FIG. 3B is a front isometric view of the covering system of FIG. 1 with the shade in a partially-extended position.
Figure 4B:
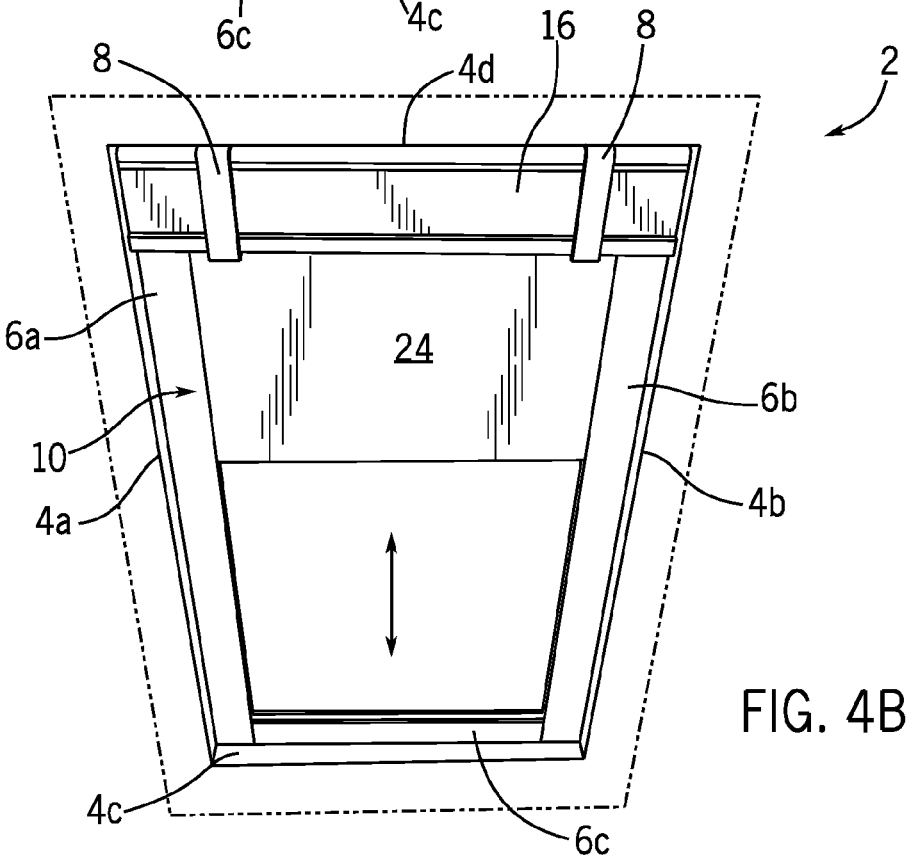
FIG. 4B is a rear isometric view of the covering system of FIG. 1 with the shade in the partially-extended position illustrated in FIG. 3B.

As illustrated in FIGS. 7A, 7B, 12, and 13, the lower edges 30, 32 of the first and second shades 22, 24, respectively, may be substantially horizontally aligned so that in a fully extended position (see FIG. 7A and 12), the lower edge 32 of the second shade 24 resides within the bottom frame member 6*c* and the lower edge 30 of the first shade 22 substantially conceals the bottom frame member 6*c* from a front side of the covering 10. With reference to FIGS. 3B and 4B, the first and second shades 22, 24 have been raised in conjunction with one another into a partially-extended position in which the lower edges 30, 32 of the first and second shades 22, 24 remain substantially horizontally aligned relative to one another. In this relative position, the second shade 24 may be substantially concealed from view by the first shade 22 from a front or room-side view of the retractable covering 10 (see FIG. 3B). Similarly, as illustrated in FIG. 4B, the first shade 24 may be substantially concealed from view by the second shade 24 from a rear or road-side view of the retractable covering 10. The first shade 22, the second shade 24, or both may be decorative for aesthetically purposes.

An example of the acoustical covering described above and depicted in FIGS. 1-13 was tested in an acoustical laboratory to determine the sound transmission class of the covering. Measurements were made in accordance with the requirements of the American Society for Testing and Materials (ASTM) E90-09 in effect as of January 2013. The sound transmission loss (STC) of a window opening including a single pane window was compared to the STC of a window opening including a single pane window and the acoustical covering described above to determine the acoustical efficacy of the covering. The testing was performed at 76 degrees Fahrenheit, 43%, 814 mbar.

The specimens were placed in a reverberation room constructed of concrete walls. All sound pressure levels were measured using a G.R.A.S. 12.7 mm type 40AQ microphone operating on a Brüel and Kjær type 3923 rotating microphone boom. The microphone was calibrated immediately before all measurements were started using a Brüel and Kjær type 4220 pistonphone with output corrected for local barometric pressure. The microphone was connected to a National Instruments digital frequency analyzer that was configured to average the microphone output over multiple sample/decay periods. The sound field decay was measured by taking 500 8-millisecond measurements. Each 8-millisecond period was linearly averaged. Measurements were made at the third-octave bands covering a center frequency range from 100 to 5,000 Hz. The rate of sound field decay was determined by the method specified in C 423-08a, which suggests using a regressive fit to the average of 10 ensembles, each of which consists of 5 decays.

The microphone was connected to a National Instruments digital frequency analyzer that was configured to average the microphone output over multiple sample/decay periods. The analyzer was configured to average sound pressure levels (SPLs) over a sampling period of 64 seconds during the measurements of noise reduction (NR) and background levels, and was configured to average the microphone output over multiple sample/decay periods during the measurement of the receive room absorption. The rate of sound field decay was determined by making a regressive fit to the average of 25 decays. All measurements were made at third-octave bands covering a center frequency range from 100 to 5,000 Hz, inclusive.

The single pane window provided a STL of about 27 decibels. The single pane window with the described covering provided a STL of between about 28 and 45 decibels. In one implementation, the single pane window with the described covering provided a STL of about 36 decibels. An increase in STL of 10 decibels is equivalent to about a one-half reduction in the sound transmission. Thus, in one implementation, the described covering reduced the sound transmitted through a single pane window by about one-half.

The foregoing description has broad application. While the provided examples describe the first shade as being a Roman shade, it should be appreciated that the first shade may be a roller shade, a cellular shade, or many other suitable types of shades. Further, while the provided examples describe the covering in connection with a window opening, the covering may be used in connection with many types of architectural openings. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, laminated, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A sound attenuating covering for an architectural opening, comprising:

a head rail;

a rotatable roller housed within the head rail;

a frame including opposing side members defining opposing, vertically-extending channels;

a first shade positioned forward of the side members, the first shade suspended from the head rail and operably coupled to the roller so that rotation of the roller in a retraction direction gathers the first shade adjacent the head rail; and a second shade positioned rearward of the first shade and slidably received within the channels of the side members, the second shade operably coupled to the roller so that rotation of the roller in the retraction direction wraps the second shade around the roller.

2. The covering of claim 1, wherein:

the first shade includes a front sheet and a rear sheet attached together at a plurality of vertically-spaced, horizontally-extending locations; and the front sheet has a longer length than the rear sheet between adjacent vertically-spaced locations and forms a droop between the adjacent vertically-spaced locations.

3. The covering of claim 2, wherein the first shade further includes an intermediate sheet secured to a rear surface of the front sheet.

4. The covering of claim 2, wherein:

the front and rear sheets comprise a woven fabric material; and the intermediate sheet comprises a non-woven material.

5. The covering of claim 1, wherein the second shade comprises a sound attenuating material.

6. The covering of claim 5, wherein the second shade comprises a layer of foam material and a layer of film material.

7. The covering of claim 1, wherein the frame further includes a bottom member defining a horizontally-extending channel configured to receive a bottom portion of the second shade.

8. The covering of claim 7, further comprising a seal strip coupled to the side and bottom members of the frame along the channels.

9. The covering of claim 1, wherein the first shade defines a plurality of horizontally-extending, transversely-collapsible cells.

10. The covering of claim 1, wherein:

the first shade includes a front sheet, a rear sheet, and an intermediate sheet attached to a rear surface of the front sheet;

the front and rear sheets comprise a woven fabric material; and the intermediate sheet comprises a non-woven material.

11. The covering of claim 1, wherein the second shade comprises a foam.

12. The covering of claim 1, wherein the first and second shades are substantially aligned along respective bottom edges and move in unison with one another.

13. The covering of claim 1, wherein:

the architectural opening comprises a single pane window; and the combination of the single pane window and the sound attenuating covering results in a sound transmission loss of between about 28 and 45 decibels.

14. The covering of claim 13, wherein the sound transmission loss is about 36 decibels.

15. The covering of claim 1, wherein the second shade is movable across the architectural opening in unison with the first shade.

16. The covering of claim 15, further comprising:

a plurality of retainers removably coupled to the first shade at vertically-spaced locations; and a flexible strip of material having an upper end portion and a lower end portion, the upper end portion coupled to the roller, the lower end portion coupled to a lowermost retainer of the plurality of retainers, the strip of material wrappable about the roller and slidably positioned between the first shade and a remainder of the plurality of retainers.

17. The covering of claim 16, wherein when the roller is rotated in the retraction direction, corresponding lengths of the strip of material and the second shade wrap about the roller.

* * * * *